US010780708B2

(12) United States Patent
Yoshizawa et al.

(10) Patent No.: US 10,780,708 B2
(45) Date of Patent: Sep. 22, 2020

(54) PRINTER

(71) Applicants: CITIZEN WATCH CO., LTD., Nishitokyo-shi, Tokyo (JP); CITIZEN SYSTEMS JAPAN CO., LTD., Nishitokyo-shi, Tokyo (JP)

(72) Inventors: Masao Yoshizawa, Tokyo (JP); Takeshi Yamazaki, Tokyo (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 16/275,506

(22) Filed: Feb. 14, 2019

(65) Prior Publication Data

US 2019/0176479 A1 Jun. 13, 2019

Related U.S. Application Data

(63) Continuation of application No. PCT/JP2017/029693, filed on Aug. 18, 2017.

(30) Foreign Application Priority Data

Sep. 15, 2016 (JP) ..... 2016-0180409

(51) Int. Cl.
*B41J 33/14* (2006.01)
*B41J 33/22* (2006.01)
(Continued)

(52) U.S. Cl.
CPC ..... *B41J 2/325* (2013.01); *B41J 17/02* (2013.01); *B41J 33/22* (2013.01); *B41J 33/24* (2013.01)

(58) Field of Classification Search
CPC ... B41J 2/325; B41J 33/22; B41J 17/02; B41J 33/24
See application file for complete search history.

(56) References Cited

U.S. PATENT DOCUMENTS 4,661,826 A 4/1987 Saitou
5,666,880 A 9/1997 Barrus
(Continued)

FOREIGN PATENT DOCUMENTS

CN 1410842 A 4/2003
CN 1427311 A 7/2003
(Continued)

OTHER PUBLICATIONS

Machine translation of CN-1588329, published on Mar. 2005 (Year: 2005).*
(Continued)

*Primary Examiner* — Huan H Tran
(74) *Attorney, Agent, or Firm* — Myers Wolin, LLC

(57) ABSTRACT

In a printer that drives by a ribbon motor (302), a winding axle that holds an ink ribbon positioned between a thermal head that performs a photographic printing operation with respect to a photographic medium conveyed along a sub-scanning direction and a platen that opposes the photographic print head with the photographic medium between the photographic print head and the platen, a flywheel (303) is coupled to a shaft of the ribbon motor (302), and a rotational force of the ribbon motor (302) is transmitted to the winding axle, via a worm gear (501) and a helical gear (502).

4 Claims, 9 Drawing Sheets

(51) Int. Cl.

| | |
|---|---|
| ***B41J 2/325*** | (2006.01) |
| ***B41J 17/02*** | (2006.01) |
| ***B41J 33/24*** | (2006.01) |

(56) References Cited

U.S. PATENT DOCUMENTS

| | | | | |
|---|---|---|---|---|
| 2002/0158399 | A1* | 10/2002 | Heno | B41J 2/325 271/3.14 |
| 2003/0068177 | A1 | 4/2003 | Kitayama | |
| 2003/0113133 | A1 | 6/2003 | Ryuzaki et al. | |
| 2007/0172286 | A1 | 7/2007 | Pomfret | |

FOREIGN PATENT DOCUMENTS

| | | | |
|---|---|---|---|
| CN | 1588229 | A | 3/2005 |
| JP | 54-121820 | A | 9/1979 |
| JP | 60-247585 | A | 12/1985 |
| JP | 3-234567 | A | 10/1991 |
| JP | 7-17120 | A | 1/1995 |
| JP | 8-154357 | A | 6/1996 |
| JP | 8-194354 | A | 7/1996 |
| JP | 9-118027 | A | 5/1997 |
| JP | 10-840 | A | 1/1998 |
| JP | 2007-229946 | A | 9/2007 |
| JP | 2008-980 | A | 1/2008 |

OTHER PUBLICATIONS

International Search Report issued by the Japan Patent Office for corresponding International Patent Application No. PCT/JP2017/029693, dated Sep. 26, 2017, with an English translation.

Notice of Reasons for Refusal issued by the Japan Patent Office for corresponding Japanese Patent Application No. 2016-180409, dated Dec. 3, 2019, with an English translation.

First Office Action issued by the China National Intellectual Property Administration for corresponding Chinese Patent Application No. 201780057079.3, dated Apr. 7, 2020, with an English machine translation.

* cited by examiner

PRINTER

CROSS-REFERENCE TO RELATED APPLICATIONS

This application is a continuation application of International Application PCT/CN2017/029693 filed on Aug. 18, 2017 and claims priority to Japanese Patent Application No. 2016/180409, filed Sep. 15, 2016, the entire contents of each are incorporated herein by reference.

TECHNICAL FIELD

The present invention relates to a printer that uses an ink ribbon and performs photographic printing.

BACKGROUND ART

Conventionally, among printers that perform a photographic printing operation of a so-called sublimation transfer technique of transferring a sublimation dye (sublimation colorant) contained in an ink ribbon to a photographic medium, one is configured to use a DC motor to wind the ink ribbon conveyed corresponding to conveyance of the photographic medium. Further, among such printers, one is configured to transmit rotation of the DC motor to a winding axle of the ink ribbon via a worm gear and a helical gear, after reducing the rotational speed.

As a related technique, conventionally, there has been a technique of reducing the rotation of the DC motor by a worm gear and a worm wheel, and transmitting the rotation to a ribbon feed gear so as to wind a ribbon (e.g., refer to Patent Document 1 below). As a further related technique, conventionally, there has been a technology related to an image forming apparatus in which support axles respectively support, in a rotatable manner, plural image carriers arranged side-by-side, the support axles being provided with a flywheel for reducing rotational speed variation, and the flywheels being arranged so that parts thereof in contact with each other overlap along an axial direction of the image carriers (for example, refer to Patent Document 2 below).

Patent Document 1: Japanese Laid-Open Patent Publication No. H10-840

Patent Document 2: Japanese Laid-Open Patent Publication No. H8-194354

DISCLOSURE OF INVENTION

Problem to be Solved by the Invention

Nonetheless, with the described conventional techniques, between the worm gear and the helical gear, rotational variation occurs when the gears ride over teeth, the rotational variation is transmitted to the winding axle of the ink ribbon, and variation in conveyance speed of the ink ribbon occurs. As a result, a problem arises in that in photographic printed matter, photographic printing quality decreases due to an occurring photographic printing variation of a pitch of the gears.

Such a decrease in photographic printing quality caused by rotational variation occurs conspicuously toward the end of use of the ink ribbon when ribbon diameter is large and torque applied to rotary driving of the winding axle increases, in low-temperature environments requiring increased ribbon tension due to increased peeling force of the ribbon, and in a high-density/high image-quality photographic printing mode in which printing speed is set to be slower.

As a countermeasure for this, conventionally, when a module of the helical gear is made smaller to increase the gear ratio, a problem arises in that the speed during ribbon feeding slows and throughput of the photographic printing decreases. A further problem arises in that due to making the module smaller, durability of the module decreases.

To solve the problems of the described conventional techniques, one object of the present invention is to provide a printer that can facilitate improvement of the photographic printing quality.

Means for Solving Problem

To solve the problems described above and achieve an object, a printer according to the present invention is characterized in having a motor that includes a shaft rotatable around an axis; a winding axle that freely holds for winding, an ink ribbon positioned between a photographic print head that performs a photographic printing operation with respect to a photographic medium conveyed along a sub-scanning direction and a platen that opposes the photographic print head with the photographic medium between the photographic print head and the platen; a rotation transmitting mechanism that transmits to the winding axle, a rotational force of the shaft included in the motor; and a flywheel that is coupled with the shaft.

Further, the printer according to the present invention, in the invention above, is characterized in further having a sending out axle that freely holds for sending out, the ink ribbon taken up by the winding axle; and a control unit that controls rotation of the motor, where the control unit adjusts according to an outer diameter of the ink ribbon held by the winding axle or the sending out axle, a timing at which the rotation of the motor is stopped.

Further, the printer according to the present invention, in the invention above, is characterized in that the control unit adjusts the timing at which the rotation of the motor is stopped so that a stopping period necessary until the rotation of the motor stops becomes shorter, as the outer diameter of the ink ribbon held by the winding axle increases or as the outer diameter of the ink ribbon held by the sending out axle decreases.

Further, the printer according to the present invention, in the invention above, is characterized in further having a control unit that controls rotation of the motor, where the control unit stops the rotation of the motor after reducing the rotation of the motor stepwise.

Further, the printer according to the present invention, in the invention above, is characterized in further having a control unit that controls the motor, where the control unit, based on a rotational speed of the motor during rotation, identifies a rotation amount of the winding axle for the winding axle to stop and based on the identified rotation amount, performs control of stopping the rotation of the motor.

Effect of the Invention

The printer according to the present invention achieves an effect in that improvement of the photographic printing quality can be facilitated.

BEST MODE (S) FOR CARRYING OUT THE INVENTION

Preferred embodiments of a printer according to the present invention will be described in detail below with reference to the accompanying drawings.

(Exterior of Printer)

Figure 1:
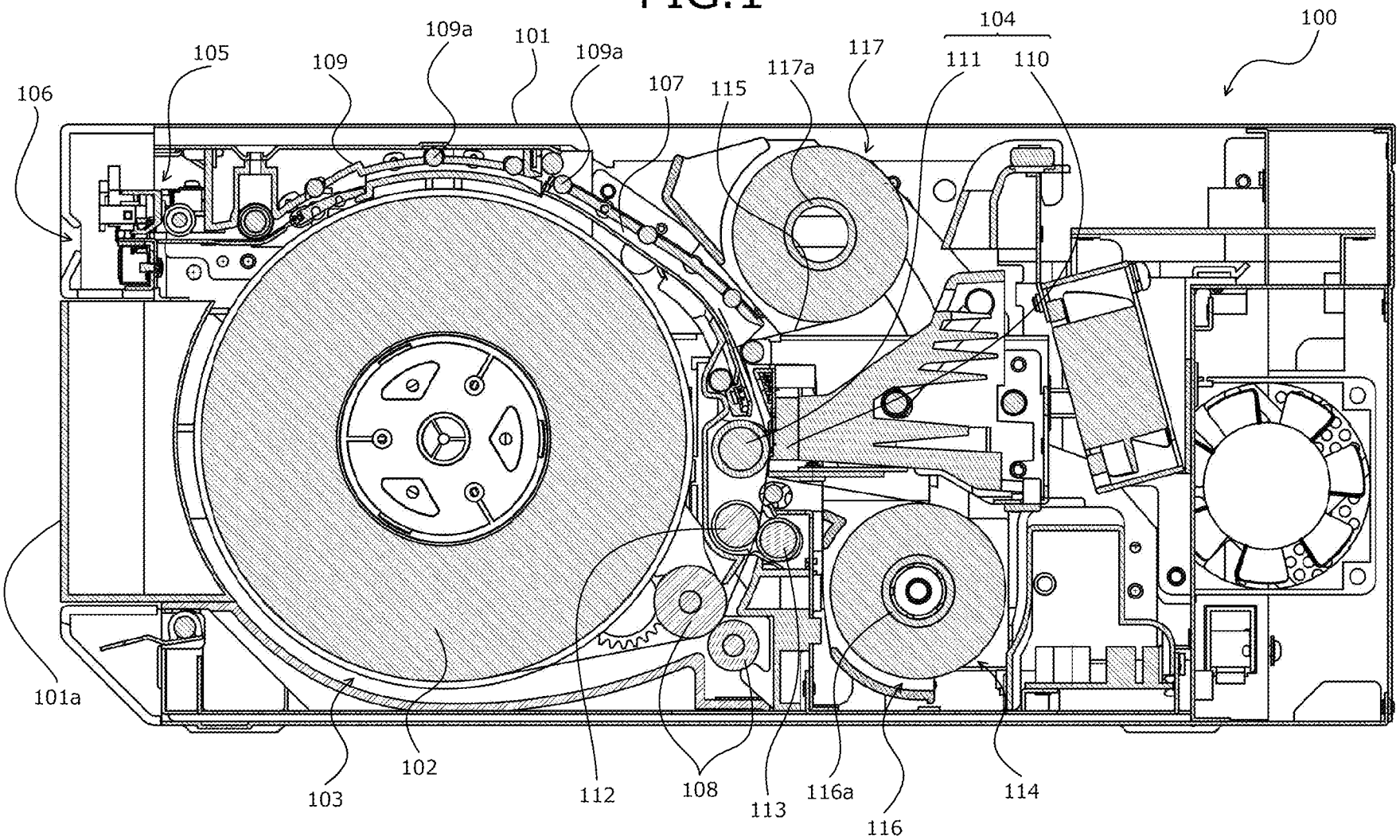
FIG. 1 is a diagram (part 1) depicting a configuration of a printer of an embodiment according to the present invention.
Figure 2:
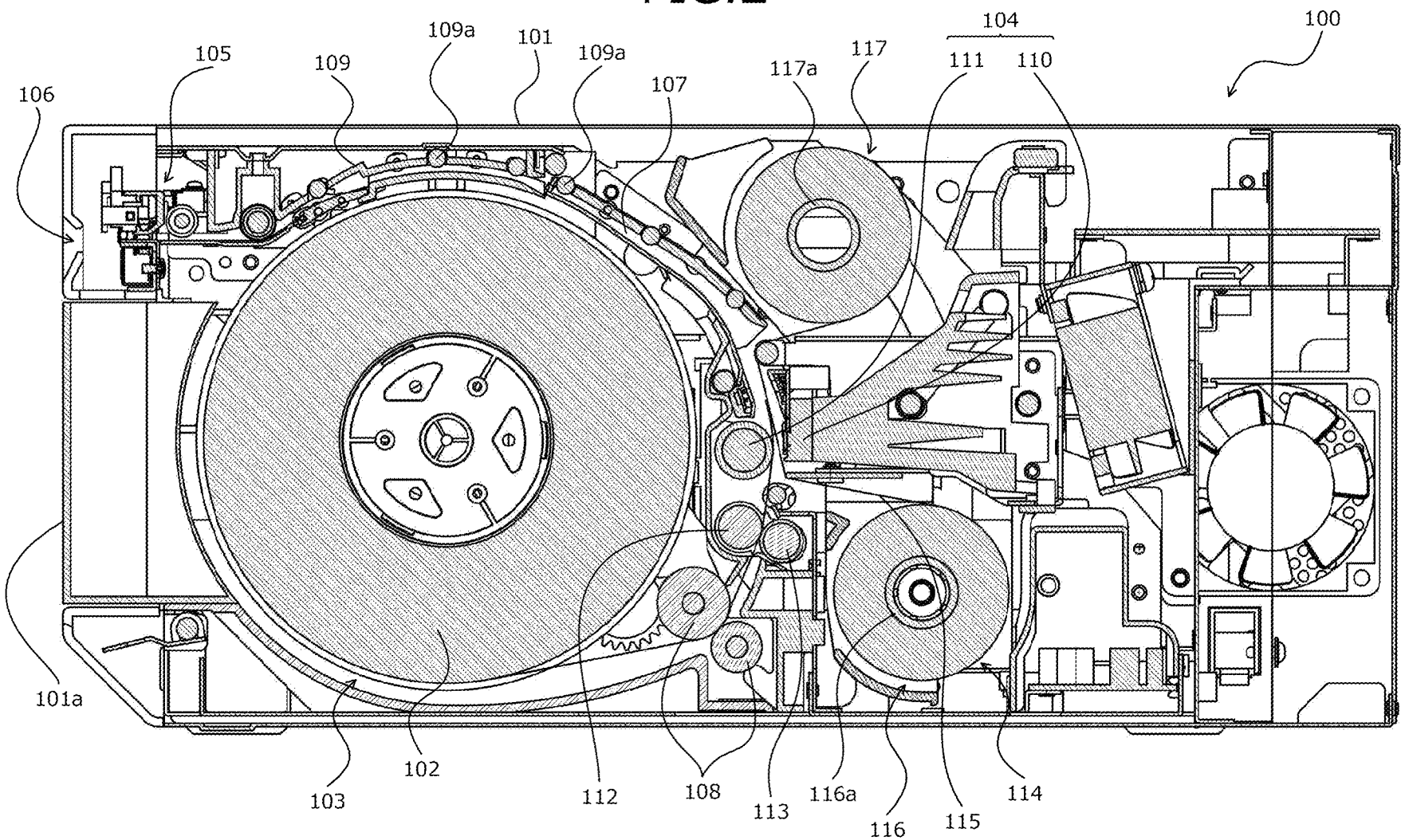
FIG. 2 is a diagram (part 2) depicting the configuration of the printer of the embodiment according to the present invention.

FIGS. 1 and 2 are diagrams depicting a configuration of a printer of an embodiment according to the present invention. In FIGS. 1 and 2, a cross-section of the printer cut along a sub-scanning direction is depicted. In FIG. 1, the printer is depicted in a state when performing photographic printing. In FIG. 2, the printer is depicted in a state when not performing the photographic printing.

In FIGS. 1 and 2, a printer 100 of the embodiment according to the present invention includes a housing 101 having a substantially box-shape. The printer 100 includes, in the housing 101, a photographic medium supporting unit 103 that supports a photographic medium (recording medium) 102 subject to the photographic printing. The photographic medium supporting unit 103 supports the photographic medium 102 that is wound in a roll. The photographic medium 102 includes a photographic printing layer (recording layer). The photographic printing layer of the photographic medium 102 is provided on a surface of a base material formed by paper, etc. The photographic printing layer is constituted by a thermal insulating layer applied or bonded to the base material, and an absorbing layer stacked on the thermal insulating layer.

In the photographic medium supporting unit 103, the photographic medium supporting unit 103 supports the photographic medium 102 enabling rotation of the photographic medium 102, which is wound in a roll. The photographic medium supporting unit 103 supports an axle of the photographic medium 102 enabling rotation of the axle of the photographic medium 102 wound in a roll, and thereby, rotatably supports the photographic medium 102.

The photographic medium supporting unit 103 is coupled to a motor (refer to FIG. 3) via a predetermined gear train, and rotates the axle of the photographic medium 102 by a driving force of the motor transmitted via the predetermined gear train. The photographic medium supporting unit 103 selectively rotates in a direction pulling out (sending out) the photographic medium 102 from the photographic medium supporting unit 103 and a direction drawing the photographic medium 102 in the photographic medium supporting unit 103.

In the housing 101, a conveyance path 107 is provided from a pull-out position of the photographic medium 102 in the photographic medium supporting unit 103, sequentially through a photographic printing unit 104 and a cutter mechanism 105, to a discharge outlet 106 provided on a front of the housing 101. In the conveyance path 107, between the photographic medium supporting unit 103 and the photographic printing unit 104, a pickup roller pair 108 is provided that pulls out and conveys to the photographic printing unit 104, the photographic medium 102 supported by the photographic medium supporting unit 103. Of the pickup roller pair 108, at least one pickup roller is connected to the motor via a predetermined gear train (none of which are depicted).

In the conveyance path 107, a guide member 109 is provided that guides a position of the photographic medium 102 so that the photographic medium 102 to be subject to the photographic printing is conveyed in the conveyance path 107. The guide member 109 guides the position of the photographic medium 102 so that the photographic medium 102 pulled out from the photographic medium supporting unit 103 is conveyed to the cutter mechanism 105 after passing the photographic printing unit 104.

The guide member 109 is provided with a conveyance auxiliary member for smoothly conveying the photographic medium 102 in the conveyance path 107. The conveyance auxiliary member, for example, is constituted by a receiving part forming an arc shape and provided to the guide member 109, a sphere or roller 109*a* fitted in the receiving part, and the like.

The photographic printing unit 104 includes a thermal head 110 and a platen roller 111. The thermal head 110 and the platen roller 111 are disposed opposing each other with the conveyance path 107 between the thermal head 110 and the platen roller 111. The thermal head 110 is provided enabling movement to a position contacting the platen roller 111 (refer to FIG. 1) and a position separated from the platen roller 111 (refer to FIG. 2).

The thermal head 110 includes plural heating elements (heating resistors: not depicted) arranged in a line along a width direction of the photographic medium 102, a driver IC (refer to FIG. 7) that drives the heating elements, etc. The driver IC is driven and controlled by a micro-computer (refer to FIG. 7) included in the printer 100. The driver IC is driven and controlled by the micro-computer, whereby electrode wires connected to the heating elements in the thermal head 110 are selectively energized from a non-depicted power source, thereby heating the heating elements that correspond to the energized electrode wire.

The platen roller 111 has a cylindrical shape having an axial direction along the width direction of the photographic medium 102, the platen roller 111 being provided enabling rotation around an axis. The platen roller 111 is provided enabling rotation in a counter-clockwise direction (forward direction) in FIGS. 1 and 2 and in a clockwise direction (reverse direction) in FIGS. 1 and 2. The platen roller 111 is coupled with the motor (refer to FIG. 7), via a predetermined gear train. The platen roller 111 rotates as a consequence of transmission of the driving force of the motor connected via the predetermined gear train. The platen roller 111 receives pressure applied to the photographic medium 102 by the thermal head 110 that opposes the platen roller 111 and sandwiches the photographic medium 102 with the platen roller 111.

In the housing 101, a grip roller 112 and a pinch roller 113 are provided. The grip roller 112 and the pinch roller 113 are disposed opposing each other with the conveyance path 107 between the grip roller 112 and the pinch roller 113. The grip roller 112 and the pinch roller 113, in the conveyance path 107, are provided further toward the photographic medium supporting unit 103 than is the photographic printing unit 104.

The grip roller 112 is provided on a rear surface side of a photographic printing surface of the photographic medium 102 during the photographic printing operation. The pinch roller 113 is biased in a direction to abut the grip roller 112 disposed opposing the pinch roller 113. As a result, at a nipping part where the grip roller 112 and the pinch roller 113 abut, the photographic medium 102 conveyed on the conveyance path 107 can be sandwiched.

The grip roller 112 has a protuberance (not depicted) protruding in an outer circumferential direction. As a result, slipping of the grip roller 112 and the photographic medium 102 can be prevented. A force (gripping force) by which the grip roller 112 and the pinch roller 113 can sandwich and convey the photographic medium 102 is established to be sufficiently larger than a load received by the photographic medium 102 from the photographic printing unit 104 and the conveyance path 107. As a result, slipping of the grip roller 112 and the photographic medium 102 can be assuredly prevented.

The grip roller 112 is coupled with the motor (Refer to FIG. 7), via a predetermined gear train. As a result, in a state with the photographic medium 102 sandwiched between the grip roller 112 and the pinch roller 113, the grip roller 112 can be rotated. Rotation of the grip roller 112 in the state with the photographic medium 102 sandwiched between the grip roller 112 and the pinch roller 113 enables control of the position of the photographic medium 102 with respect to a photographic printing position by the photographic printing unit 104.

In the housing 101, in a vicinity of the platen roller 111, a photographic medium detection sensor (Refer to FIG. 7) that detects a lead-end position of the photographic medium 102 pulled out into the conveyance path 107 from the photographic medium supporting unit 103 is provided. The photographic medium detection sensor, for example, can be realized by an optical sensor that includes a light emitting element and a light receiving element disposed opposing each other with the conveyance path 107 between the light emitting element and the light receiving element, the optical sensor further varying output according to changes in a received light amount at the light receiving element. The photographic medium detection sensor may be realized by a reflection-type sensor in place of the light emitting element and the light receiving element disposed opposing each other with the conveyance path 107 between the light emitting element and the light receiving element.

The received light amount at the light receiving element varies due to the light emitted by the light emitting element becoming blocked when the photographic medium 102 conveyed in the conveyance path 107 passes between the light emitting element and the light receiving element. The printer 100 can detect the lead-end position of the photographic medium 102 pulled out into the conveyance path 107 from the photographic medium supporting unit 103, based on an output value of the photographic medium detection sensor, the output value fluctuating according to variation of the received light amount at the light receiving element (in a case of a reflection-type, fluctuating according to variation of reflected light of the rear surface of the photographic medium 102). In this manner, the photographic medium detection sensor is provided in the vicinity of the grip roller 112, whereby recording positions of colors can be matched accurately with respect to the photographic medium 102 and high-quality photographic printed matter can be obtained.

The cutter mechanism 105 is provided in a vicinity of the discharge outlet 106. The cutter mechanism 105 includes a fixed blade having a fixed position and a movable blade provided to be moveable (to be able to reciprocate) along the fixed blade, in a width direction of a photographic medium. The movable blade is in contact with the fixed blade and is provided at a position dividing the conveyance path 107. The movable blade has a disc-shape including a blade at an outer circumferential part, and is provided to be moveable (to be able to reciprocate) along the fixed blade, in the width direction of the photographic medium 102. The movable blade is positioned at a position so as to not interfere with passing of the photographic medium 102 during non-operation such as when standing by for cutting of the photographic medium 102.

The cutter mechanism 105 includes a driving source such as a movable blade driving motor, a motive power transmitting mechanism (not depicted) that transmits the driving force generated by the movable blade driving motor to the movable blade, etc. The cutter mechanism 105, in a state with a cutting position (i.e., position subject to cutting) in the photographic medium 102 conveyed in the conveyance path 107, to a position (i.e., position cut by the cutter mechanism 105) where the movable blade moves (reciprocates) so as to cross the conveyance path 107, moves the movable blade along the width direction of the photographic medium 102 by the driving force generated by the movable blade driving motor and thereby, cuts the photographic medium 102.

In the housing 101, at a lower side of the cutter mechanism 105 in a vertical direction, a cut waste collection box 101*a* is provided. The cut waste collection box 101*a* has a box-like shape with a bottom and an opening that receives cut pieces (cut waste) generated with application of the photographic printing operation on the photographic medium 102. The cut waste collection box 101*a* is attached to and removable from an opening provided to the housing 101. The cut waste collection box 101*a* holds the cut pieces (cut waste) generated with application of the photographic printing operation on the photographic medium 102 by the printer 100.

Further, the printer 100 includes a ribbon unit 114. The ribbon unit 114 holds an ink ribbon 115 so that the ink ribbon 115 is stretched between the thermal head 110 and the platen roller 111. The ink ribbon 115 held by the ribbon unit 114 includes a long base material and an ink layer provided on one surface side of the base material.

The ink layer is formed by a sublimation dye ink (ink containing a sublimation dye (sublimation colorant, thermal-diffusible colorant), i.e., a sublimation ink). In particular, the ink ribbon 115 includes ink layers for colors including yellow (Y), magenta (M), and cyan (C). The ink layers are each formed by a sublimation dye ink (ink containing a sublimation dye (sublimation colorant), i.e., a sublimation ink).

In the ink ribbon 115, the ink layers of plural colors are disposed periodically along a length direction of the base material, according to color. In particular, for example, the ink layers for yellow, magenta, and cyan are periodically disposed in a sequence of "the ink layer for yellow→the ink layer for magenta→the ink layer for cyan→ . . . ", along the length direction of the base material.

Further, the ink ribbon 115 includes an overcoat layer. The overcoat layer is disposed periodically along the length direction of the base material together with the ink layers. In particular, in the ink ribbon 115, periodic disposal along the length direction of the base material is in a sequence of "the ink layer for yellow→the ink layer for magenta→the ink layer for cyan→overcoat layer→the ink layer for yellow→ . . . ".

The ribbon unit 114 includes a winding-side holding unit 116 and a supply-side holding unit 117. The ribbon unit 114 holds the ink ribbon 115 by the winding-side holding unit 116 and the supply-side holding unit 117, in a state where the ink layer in the ink ribbon 115 opposes the platen roller 111 between the thermal head 110 and the platen roller 111.

The winding-side holding unit 116 includes a winding axle 116*a* provided enabling rotation in the clockwise direction (winding direction) and the counter-clockwise direction (rewinding direction) in FIGS. 1 and 2, and a ribbon motor unit (refer to FIGS. 3 and 4) that imparts a rotational force to the winding axle 116*a*. The winding axle 116*a* rotates by the rotational force imparted by the ribbon motor unit. The winding axle 116*a* rotates in the winding direction and thereby, winds the ink ribbon 115 from one end side of the ink ribbon 115 held by the supply-side holding unit 117.

The supply-side holding unit 117 includes a sending out axle 117*a* that holds the ink ribbon 115 enabling the ink ribbon 115, which is long and wound, to be sent out from an outer circumferential side of the ink ribbon 115. The sending out axle 117*a*, accompanying winding of the ink ribbon 115 by rotation of the winding axle 116*a* in the winding direction, rotates in the clockwise direction (sending out direction) in FIGS. 1 and 2, sending out the ink ribbon 115 from the outer circumferential side.

The ribbon unit 114 may include a rewinding mechanism that winds on the sending out axle 117*a* side, the ink ribbon 115 wound by the winding axle 116*a*. In particular, the rewinding mechanism can be constituted by a rewinding motor that is coupled to the sending out axle 117*a* and imparts a rotational force in the counter-clockwise direction (the rewinding direction) in FIGS. 1 and 2 to the sending out axle 117*a*, a gear train that transmits the rotational force of the rewinding motor to the sending out axle 117*a*, etc. (none of which are depicted).

(Photographic Printing Operation Performed by Printer 100)

Next, the photographic printing operation performed by the printer 100 above will be described. The printer 100, when receiving a photographic printing instruction from an external apparatus, performs the photographic printing operation of the sublimation transfer technique. The photographic printing operation of the sublimation transfer technique is performed by selectively energizing heating elements in the thermal head 110 and thereby selectively causing the heating elements to generate heat, and by transmitting the heat generated at the heating elements to the ink ribbon 115, and with respect to the photographic printing layer in the photographic medium 102 to be subject to the photographic printing, by subliming and transferring to the absorbing layer in the photographic medium 102, the sublimation dye ink contained in the ink layer provided to the ink ribbon 115.

In particular, the printer 100, when performing the photographic printing operation, first, rotates the axle of the photographic medium in the photographic medium supporting unit 103, and pulls out into the conveyance path 107, the photographic medium 102 that is held by the photographic medium supporting unit 103. When the photographic medium 102 is pulled out from the photographic medium supporting unit 103 and the photographic printing operation is not performed with respect to the photographic medium 102, the printer 100 separates the grip roller 112 and the pinch roller 113, and separates the thermal head 110 from the platen roller 111.

Next, the heating elements provided in the thermal head 110 are selectively caused to generate heat based on the photographic printing instruction received from the external apparatus, while the photographic medium 102 that is long, wound and pulled out into the conveyance path 107 from the photographic medium supporting unit 103 is conveyed in a direction to be drawn into the photographic medium supporting unit 103. As a result, the heat at the heating elements provided in the thermal head 110 is transmitted to the ink ribbon 115, subliming and transferring the sublimation dye ink provided in the ink ribbon 115 to the photographic medium 102, enabling the photographic printing operation to be performed with respect to the photographic medium 102.

This photographic printing operation is performed for each the color of the ink layer, by subliming and transferring the ink of each color sequentially to the photographic medium. For example, the photographic printing operation of a first color (e.g., yellow (Y)) is performed; next, the photographic printing operation of a second (e.g., magenta (M)) is performed; and subsequently the photographic printing operation of a third color (cyan (C)) is performed. The printer 100, when performing the photographic printing operation for each color, pulls out the photographic medium 102 in the conveyance path 107 until a lead-end of the photographic medium 102 that has been drawn into the photographic medium supporting unit 103 for the photographic printing operation again reaches a recording start position.

In particular, after the photographic printing operation for the first color (e.g., yellow (Y)) is performed, the photographic medium is pulled out in the conveyance path 107 until the lead-end of the photographic medium 102 reaches the recording start position. Subsequently, the photographic printing operation for the second color (e.g., magenta (M)) is performed, and after the photographic printing operation for the second color (e.g., magenta (M)) is performed, the photographic medium 102 is pulled out in the conveyance path 107 until the lead-end of the photographic medium 102 reaches the recording start position. The photographic printing operation for the third color (cyan (C)) is also similarly performed.

Subsequently, after the photographic printing operation has been performed for all of the colors with respect to one surface of the photographic medium 102, the overcoat layer is provided on the photographic printing surface of the photographic medium 102 subject to the photographic printing operations. The printer 100, with the photographic medium 102 pulled out in the conveyance path 107 until the lead-end of the photographic medium 102 subject to the photographic printing operations reaches the recording start position, provides the overcoat layer on the photographic printing surface of the photographic medium 102 subject to the photographic printing operations and thereby, performs a laminating process. The overcoat layer is provided on the entire photographic printing surface subject to the photographic printing operations. As a result, degradation of water resistance capability and of weather resistance capability of the sublimation dye ink in the photographic printed matter is suppressed, enabling water resistance and weather resistance of the photographic printed matter to be increased.

The printer 100 can adjust concentration of the ink transferred to the photographic medium 102 for each dot to be recorded by performing the photographic printing operation of the sublimation transfer technique. Therefore, the printer 100, which performs the photographic printing operation of the sublimation transfer technique, is excellent in expressing gradations. The printer 100, which performs the photographic printing operation of the sublimation transfer technique, is capable of excellent gradation expression and therefore, can obtain image quality that can be sustained even for photographic printing applications. The printer 100 performing the photographic printing operation of the sublimation transfer technique such as this, for example, is referred to as a sublimation-type printer (Dye-sublimation printer) or the like.

Next, the printer 100 drives and controls a corresponding motor driver 704, and conveys the photographic medium 102 toward the discharge outlet 106 until a boundary between a photographic printed portion and a non-photographic printed portion toward the lead-end on a lead-end side of the photographic medium 102 to which the overcoat layer has been provided reaches the position where the cutter mechanism 105 cuts. Subsequently, the corresponding motor driver 704 is driven and controlled, and the boundary between the photographic printed portion and the non-photographic printed portion toward the lead-end on the lead-end side of the photographic medium 102 to which recording has been performed is cut. As a result, in the photographic medium 102 subject to the photographic printing, a margin from the boundary between the photographic printed portion and the non-photographic printed portion toward the lead-end on the lead-end side to the lead-end is cut from the photographic printed matter. A margin piece generated by this cutting is stored in the cut waste collection box 101*a*.

Next, the photographic medium 102 is conveyed toward the discharge outlet 106 until the photographic printed portion in the photographic medium 102 from which the margin on the lead-end has been cut passes the position where the cutter mechanism 105 cuts, and a boundary between the photographic printed portion and a non-photographic printed portion toward the photographic medium supporting unit 103 reaches the position where the cutter mechanism 105 cuts. Subsequently, the corresponding motor driver 704 is driven and controlled, and on the lead-end side of the photographic medium 102 to which the recording has been performed, the boundary of the photographic printed portion and the non-photographic printed portion toward the photographic medium supporting unit 103 is cut. As a result, in the photographic medium 102 to which the recording has been performed, the boundary between the photographic printed portion and the non-photographic printed portion toward the photographic medium supporting unit 103 is cut, forming a tail-end of the photographic printed matter.

In this manner, both ends of the photographic printed portion of the photographic medium 102 subject to the photographic printing are cut, whereby margin-less photographic printed matter (borderless photographic printed matter) can be provided. The photographic medium 102 from which margins on both ends have been cut becomes the photographic medium 102 having a single-sheet shape from the photographic medium 102 that is long. The printer 100 discharges the photographic medium 102 having a single-sheet shape from the discharge outlet 106 to outside the printer 100.

As described, the printer 100, in the photographic printing operations, superimposes images of the colors yellow (Y), magenta (M) and cyan (C), separately according to color. In such a printer, boundary positions of each color in the ink ribbon 115, positions of the ink layers of each color with respect to the photographic medium 102, etc. have to be controlled so that the photographic printing positions of the images of each color do not shift, and the photographic printing start position in the photographic medium 102 has to be accurately controlled. The printer 100 of the embodiment according to the present invention controls the position of the ink ribbon by the ribbon motor unit provided to the ribbon unit 114.

(Configuration of Ribbon Motor Unit)

Figure 3:
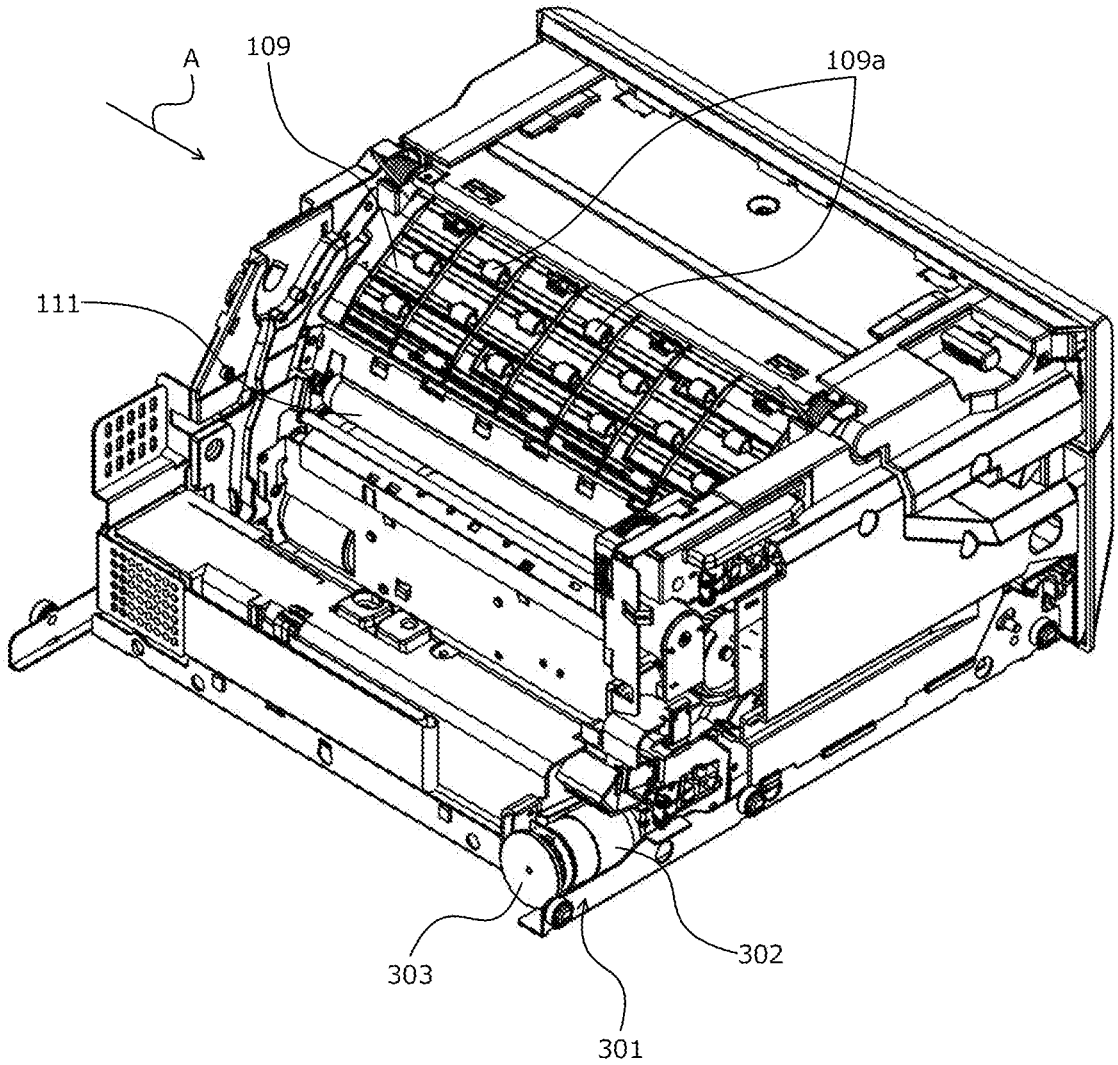
FIG. 3 is a diagram (part 1) depicting a configuration of a ribbon motor unit and an installation position of the ribbon motor unit.
Figure 4:
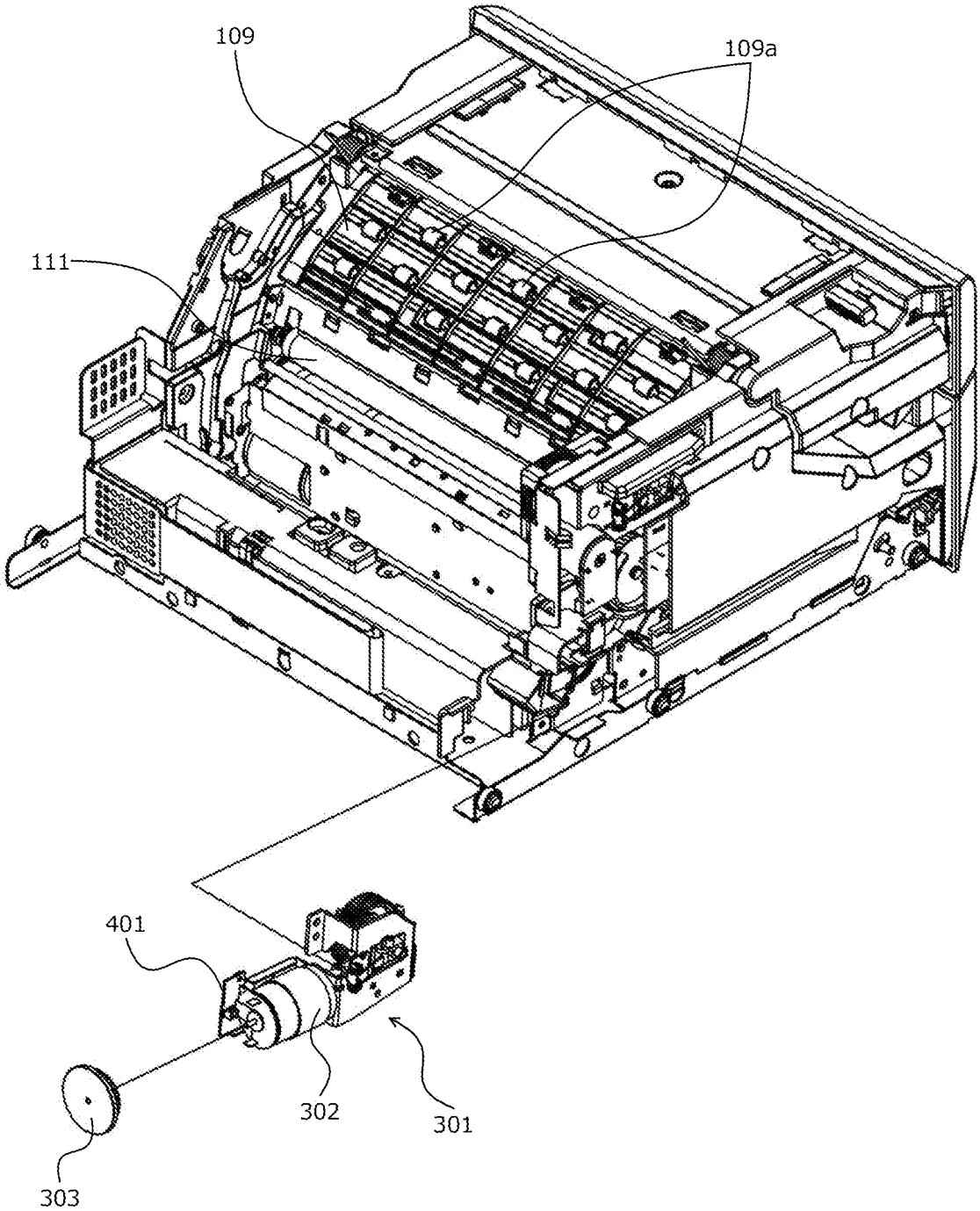
FIG. 4 is a diagram (part 2) depicting the configuration of the ribbon motor unit and the installation position of the ribbon motor unit.
Figure 5:
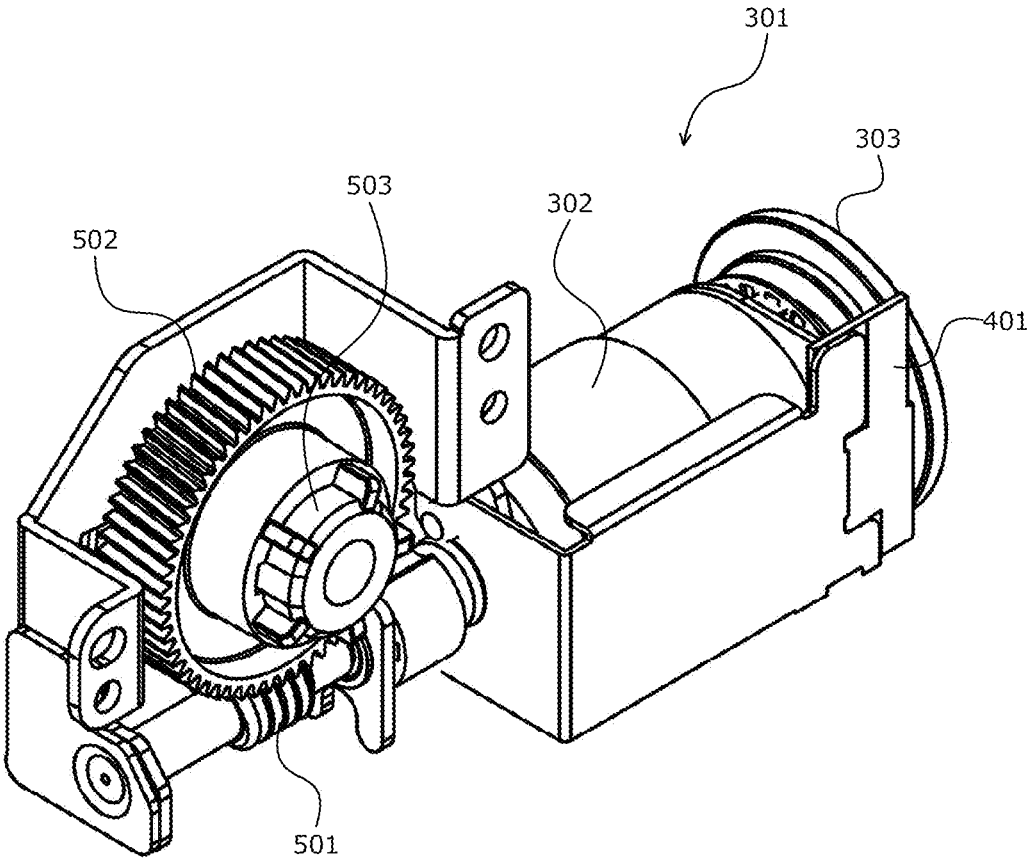
FIG. 5 is a diagram depicting the ribbon motor unit.

Next, configuration of the ribbon motor unit will be described. FIGS. 3 and 4 are diagrams depicting configuration of the ribbon motor unit and an installation position of the ribbon motor unit. In FIG. 3, a perspective view from a rear surface side of the printer 100 from which an exterior has been removed is depicted. In FIG. 4, an exploded view of the ribbon motor unit from the state in FIG. 3 is depicted. FIG. 5 is a diagram depicting the ribbon motor unit. In FIG. 5, the ribbon motor unit is depicted in a state as viewed from a direction indicated by arrow A in FIG. 3.

In FIGS. 3 to 5, a ribbon motor unit 301 is provided in the printer 100, on a side (rear surface side in the printer 100) opposite that of the photographic medium supporting unit 103 with the photographic printing unit 104 between the ribbon motor unit 301 and the photographic medium supporting unit 103. The ribbon motor unit 301 includes a ribbon motor 302, a worm gear 501, a helical gear (worm wheel) 502, a ribbon driving axle 503, a ribbon motor encoder 401, and a flywheel 303.

The ribbon motor 302 converts electrical energy into mechanical energy, more specifically, rotational energy. The ribbon motor 302 is constituted by a stator having a cylindrical shape and housed in a bracket, a rotor provided on an inner circumferential side of the stator, a shaft that can rotate around an axis, etc. In the present embodiment, the motor according to the present invention can be realized by the ribbon motor 302.

The worm gear 501 includes an axial part having a cylindrical shape coupled to one end side of the shaft of the ribbon motor 302, and a spiral-shaped groove (worm) provided at an outer circumferential surface of the axial part. An outer circumferential surface of the worm gear 501 has a screw-like shape due to the spiral-shaped groove. The helical gear 502 includes a main body part having a disc-shape and plural grooves (teeth) provided at an outer circumferential surface of the main body part, inclined with respect to an axis of the main body part. The grooves of the helical gear 502 engage with the groove of the worm gear 501.

In the present embodiment, a rotation transmitting mechanism according to the present invention can be realized by the worm gear 501 and the helical gear 502. The ribbon driving axle 503 is coupled to the helical gear 502 and rotates with the helical gear 502. The ribbon driving axle 503 is fitted in the winding axle. In the ribbon motor unit 301, rotational force of the ribbon motor 302 is transmitted to the winding axle, via the worm gear 501 and the helical gear 502, enabling speed reduction.

The ribbon motor encoder 401 outputs a signal according to the ribbon driving axle 503, i.e., the rotation of the ribbon motor 302. The ribbon motor encoder 401 can be realized by an optical rotary encoder that includes a slit disc that rotates with the rotation of the shaft included in the ribbon motor 302, a light emitting element and a light receiving element disposed opposing each other along an axial direction of the slit disc with the slit disc between the light emitting element and the light receiving element, an amplifier that amplifies an output signal from the light receiving element, etc. In place of the optical rotary encoder, the ribbon motor encoder 401 may be realized by an electromagnetic induction type encoder referred to as a resolver, etc.

The flywheel 303 is coupled to the other end of the shaft of the ribbon motor 302. The flywheel 303 has a disc-shape and is coupled to the shaft so that an axis of the disc is positioned on an extended line of an axis of the shaft of the ribbon motor 302. Provision of the flywheel 303 enables the moment of inertia of the ribbon motor 302 to be increased as compared to a case in which the flywheel 303 is not provided.

Provision of the flywheel 303 enables rapid variation of the rotational speed to be suppressed by rotation of the flywheel 303 during times of light load and release of the rotational force stored in the flywheel 303 during times of heavy load. As a result, an occurrence of variation (variability) of the rotational speed of the ribbon motor 302 can be suppressed.

The rotational energy of the flywheel 303 is proportional to the moment of inertia. Further, the rotational energy of the flywheel 303 is proportional to the square of the rotational speed (rpm). A weight and shape (thickness of the disc, diameter dimension) of the flywheel 303 can be suitably set according to a size (width dimension, etc. of the ink ribbon 115) of the ink ribbon 115 to be subject to torque and winding by the ribbon motor 302.

(Relationship of Ribbon Diameter and Rotational Speed of Ribbon Motor 302)

Figure 6:
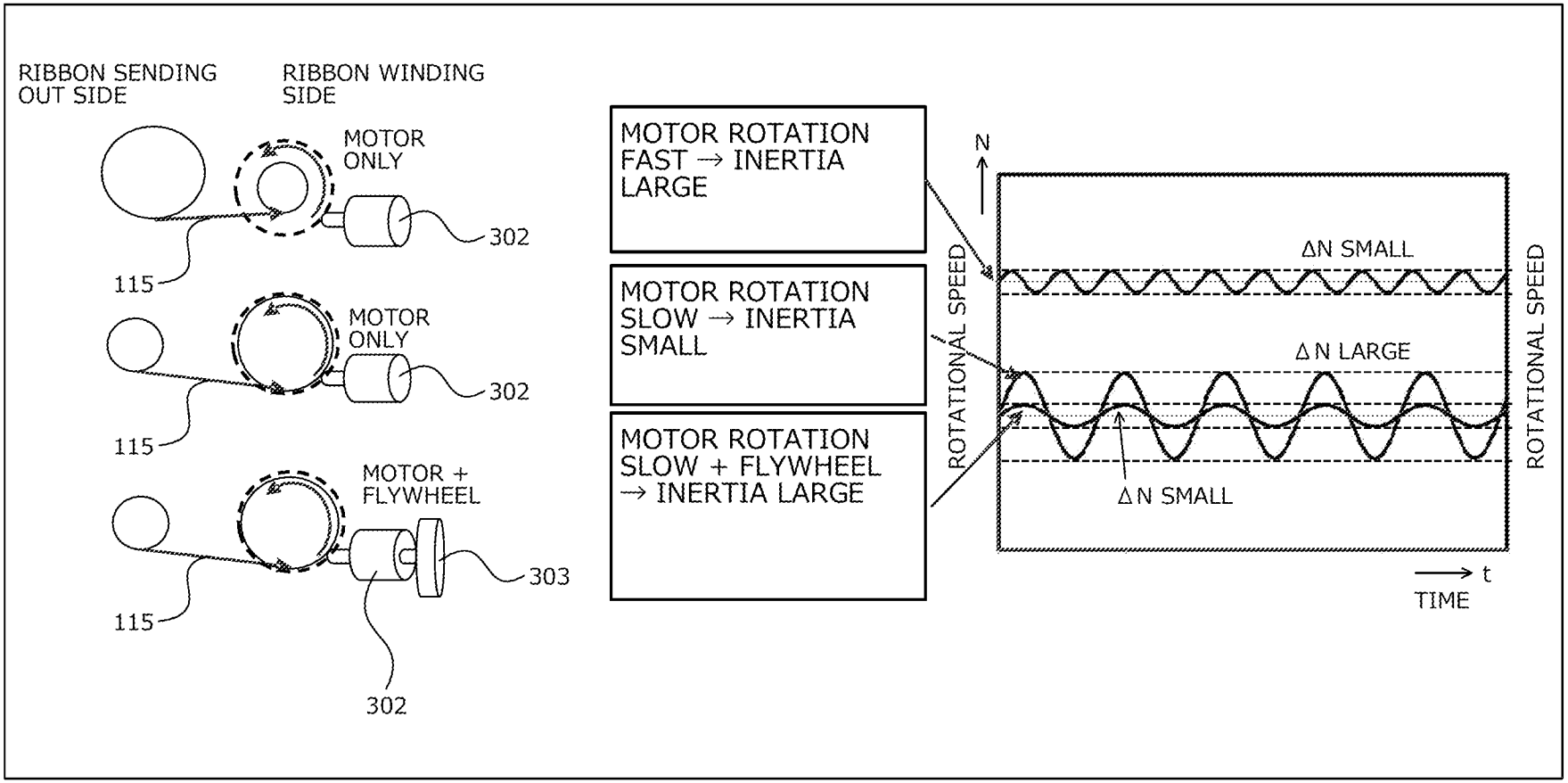
FIG. 6 is a diagram depicting a relationship of ribbon diameter and rotational speed of a ribbon motor.

Next, a relationship of ribbon diameter and the rotational speed of the ribbon motor 302 will be described. FIG. 6 is a diagram depicting a relationship of ribbon diameter and the rotational speed of the ribbon motor 302. As depicted in FIG. 6, rotation of the ribbon motor 302 varies according to the ribbon diameter. In particular, rotation of the ribbon motor 302 increases the smaller the ribbon diameter is, and decreases the larger the ribbon diameter is.

Inertia of the ribbon motor 302 increases the faster (rotating in a high-speed range) the rotational speed of the ribbon motor 302 is. In other words, when the rotational speed of the ribbon motor 302 is slow (rotating in a low-speed range), inertia of the ribbon motor 302 is smaller than in a case of rotating in the high-speed range. Therefore, when the ribbon motor 302 is rotating in the low-speed range, effects of inertia of the ribbon motor 302 are small and therefore, rotational variation at the time of riding over the teeth, between the worm gear 501 and the helical gear 502, is remarkable.

When the flywheel 303 is coupled to the ribbon motor 302, inertia due to the flywheel 303 acts on the rotation of the ribbon motor 302 and therefore, inertia of the ribbon motor 302 is large compared to a case where the flywheel 303 is not coupled. Therefore, coupling of the flywheel 303 suppresses the occurrence of variation in the conveyance speed of the ink ribbon 115 even when the ribbon motor 302 is rotating in the low-speed range, enabling occurrence of variation in the photographic printed matter and decreases in the photographic printing quality to be suppressed.

(Hardware Configuration of Printer 100)

Figure 7:
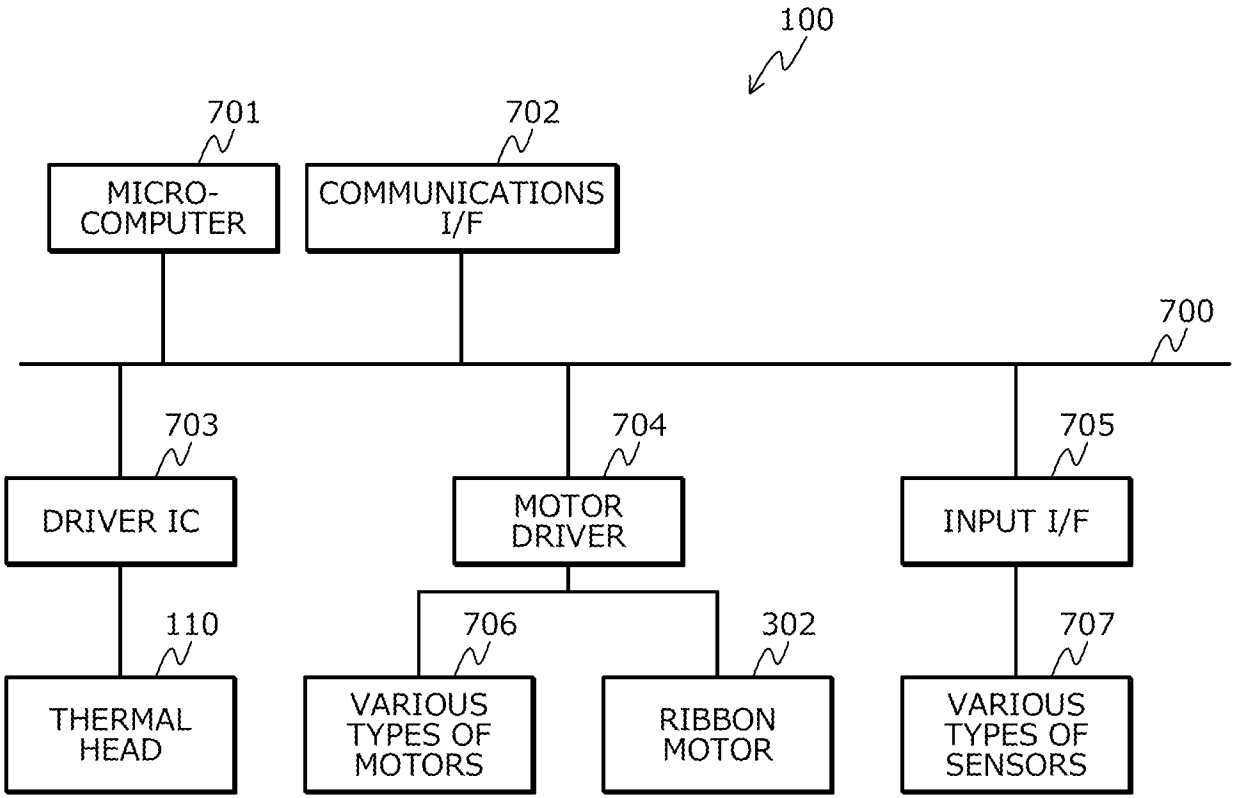
FIG. 7 is a diagram depicting hardware configuration of the printer of the embodiment according to the present invention.

Next, hardware configuration of the printer 100 of the embodiment according to the present invention will be described. FIG. 7 is a diagram depicting hardware configuration of the printer 100 of the embodiment according to the present invention.

In FIG. 7, the printer 100 includes a micro-computer 701, a communications interface (I/F) 702, the driver IC 703, the motor driver 704, and an input I/F 705. Components including the micro-computer 701, the communications I/F 702, the driver IC 703, the motor driver 704, and the input I/F 705 are connected by a bus 700.

The micro-computer 701 drives and controls the components of the printer 100. In the present embodiment, a control unit according to the present invention can be realized by the micro-computer. The micro-computer 701, for example, can be realized by a board mounted with a CPU, a memory such as a ROM, a RAM, and the like, and various types of circuits such as an input/output circuit, a timer circuit, and the like.

The micro-computer 701, based on various types of data stored in the memory of the micro-computer 701 and/or various types of data received from a non-depicted external apparatus via the communications I/F 702, executes on the CPU, various types of control programs stored in the memory and thereby, drives and control the components of the printer 100. In the micro-computer 701, the CPU, for example, uses the RAM as a work area when expanding image data for printing based on photographic printing command information.

The communications I/F 702 is connected to the non-depicted external apparatus. The communications I/F 702 may be directly connected to the external apparatus or may be connected via a network. The communications I/F 702 administers an interface between components in the printer 100 and the external apparatus, and controls the input and output of data in the printer 100.

The external apparatus, for example, generates a photographic printing instruction for the printer 100, and outputs the generated photographic printing instruction to the printer 100. The external apparatus, in particular, can be realized by a personal computer installed at a DPE store or the like that provides a service of photographic printing and outputting an image taken by a digital camera. The photographic printing instruction, for example, includes information related to an image to be photographically printed on the photographic medium 102, a command instructing photographic printing for the information.

The driver IC 703 is driven and controlled by the micro-computer 701. The driver IC 703, under driving control of the micro-computer 701, selectively electrifies electrode wires respectively corresponding to the plural heating elements of the thermal head 110 in the photographic printing unit. As a result, the heating elements can be selectively heated. The heat generated at the heating elements of the thermal head 110 is transmitted to the photographic printing layer of the photographic medium 102 via the ink ribbon 115, whereby the sublimation dye ink provided in the ink ribbon 115 is sublimed and transferred to the photographic medium 102, enabling the photographic printing operation to be performed with respect to the photographic medium 102.

The motor driver 704 is driven and controlled by the micro-computer 701. The motor driver 704 is connected to various types of motors 706 such as a switching flap driving motor coupled to a switching flap, a cutter motor that drives a cutter unit, a main step-motor coupled to the grip roller 112, a roll flange in a roll holder unit, a feed roller, the platen roller 111, etc. Further, the motor driver 704 is connected to the ribbon motor 302 in the ribbon motor unit 301. The motor driver 704, based on a control signal from the micro-computer 701, drives and controls the various types of motors connected to the motor driver 704.

The input I/F 705 is connected to various types of sensors 707, such as the photographic medium detection sensor, included in the printer 100. The various types of sensors 707 may be connected to the input I/F 705 by a universal serial bus (USB). The input I/F 705 outputs to the micro-computer 701, signals according to output values from the various types of sensors 707. The micro-computer 701, based on the signals output from the input I/F 705, drives and controls the components including in the printer 100.

(Control Method of Ribbon Stop Position)

Next, a control method of the ribbon stop position in the printer will be described. Provision of the flywheel 303 to the ribbon motor 302 increases inertia of the ribbon motor 302 (inertia) as compared to a case in which the flywheel 303 is not provided. Therefore, an occurrence of so-called over-running in which the ink ribbon 115 stops after passing a position (actual ribbon stop position) at which the ink ribbon 115 is actually desired to be stopped is a concern.

When over-running occurs, the ink ribbon 115 passes the actual ribbon stop position and stops at a position to which the ink ribbon 115 is excessively conveyed. The greater the weight of the winding axle to which the rotational force of the ribbon motor 302 is transmitted is, the greater the inertia applied to the ribbon motor 302 is and therefore, an over-run amount of the ink ribbon 115 also increases.

In the printer 100 of the embodiment according to the present invention, rotation of the ribbon motor 302 is controlled according to an outer diameter (ribbon diameter) of the ink ribbon 115 held by the winding axle and therefore, over-running due to increases in the inertia of the ribbon motor 302 can be suppressed. In particular, when the ribbon motor 302 is stopped, first, a ribbon diameter (ribbon diameter) of the winding axle 116*a* is identified.

The ribbon diameter of the winding axle 116*a*, for example, can be identified based on lengths of each of the ink layers of the colors yellow (Y), magenta (M) and cyan (C) of the ink ribbon 115 conveyed between the thermal head 110 and the platen roller 111, and the rotational speed of the winding axle. The rotational speed of the winding axle, for example, can be identified based on the output signals from the ribbon motor encoder 401.

The ribbon diameter of the winding axle 116*a* may be identified by direct detection using a sensor. Similarly, the ribbon diameter of the winding axle 116*a* may be identified based on the outer diameter of the ink ribbon 115 held by the sending out axle, by using a sensor to directly detect the outer diameter of the ink ribbon 115 held by the sending out axle. Regarding an identification method for the ribbon diameter of the winding axle 116*a*, identification can be easily performed using various commonly known techniques and therefore, description thereof is omitted herein.

Next, based on the outer diameter of the ink ribbon 115 held by the winding axle identified by the method above, a correction amount of the ribbon stop position is identified. The correction amount of the ribbon stop position can be identified by obtaining in advance using a method such as measurement, a relationship of the outer diameter of the ink ribbon 115 held by the winding axle and over-run amount.

Figure 8:
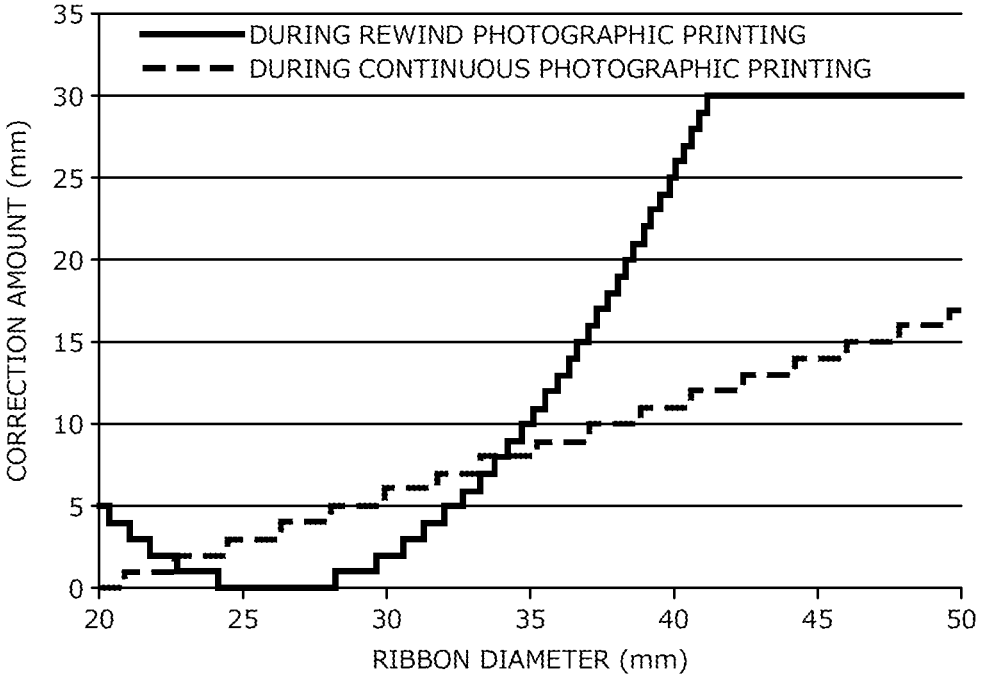
FIG. 8 is a graph depicting a relationship of diameter (ribbon diameter) of an ink ribbon held by a winding axle and correction amount of a ribbon stop position.

FIG. 8 is a graph depicting a relationship of the diameter (ribbon diameter) of the ink ribbon 115 held by the winding axle and the correction amount of the ribbon stop position. As depicted in FIG. 8, the correction amount of the ribbon stop position differs for rewind photographic printing and for continuous photographic printing. In the case of rewind photographic printing, the ink ribbon 115 is rewound on the sending out axle side and stopped at the photographic printing start position. In the case of continuous photographic printing, the ink ribbon 115 is taken up on the winding axle side and stopped at the photographic printing start position.

The correction amount of the ribbon stop position during rewind photographic printing is adjusted to be larger, the larger the ribbon diameter of the winding axle 116*a* is. Further, the correction amount of the ribbon stop position during rewind photographic printing is adjusted to increase stepwise according to the ribbon diameter of the winding axle 116*a*. The correction amount of the ribbon stop position during rewind photographic printing may be adjusted to increase non-stepwise according to the ribbon diameter of the winding axle 116*a*.

In the printer, a stop position correction table storing correction amounts according to the ribbon diameter of the winding axle 116*a* is stored in advance in the memory of the micro-computer 701 and thus, when the photographic printing is stopped, the stop position correction table is referred to, the correction amount corresponding to the identified ribbon diameter of the winding axle 116*a* is extracted, and the ribbon motor 302 is driven and controlled so that the ink ribbon 115 stops at a position that takes into consideration the extracted correction amount. The ribbon motor 302 takes the over-running of the ink ribbon 115 into account, and drives and controls the ink ribbon 115 to stop short of the actual ribbon stop position by the correction amount.

The stop position correction table is referred to and the correction amount is identified, whereby processing load of the micro-computer 701 is reduced, enabling faster control. The correction amount may be calculated based on a numerical formula that approximates the over-run amount according to the ribbon diameter of the winding axle 116*a*, for each control stopping the photographic printing.

The correction amount of the ribbon stop position during continuous photographic printing is adjusted to be smaller, the larger the ribbon diameter of the winding axle 116*a* is, when the ribbon diameter of the winding axle 116*a* is in a first range. Further, the correction amount of the ribbon stop position during continuous photographic printing is adjusted to be zero regardless of the ribbon diameter of the winding axle 116*a*, when the ribbon diameter of the winding axle 116*a* is in a second range.

Furthermore, the correction amount of the ribbon stop position during continuous photographic printing is adjusted to be larger, the larger the ribbon diameter of the winding axle 116*a* is, when the ribbon diameter of the winding axle 116*a* is in a third range. During continuous photographic printing, the correction amount when the ribbon diameter of the winding axle 116*a* is in the third range has a variation range that is greater than the correction amount during rewind photographic printing.

(Process Procedure of Printer)

Figure 9:
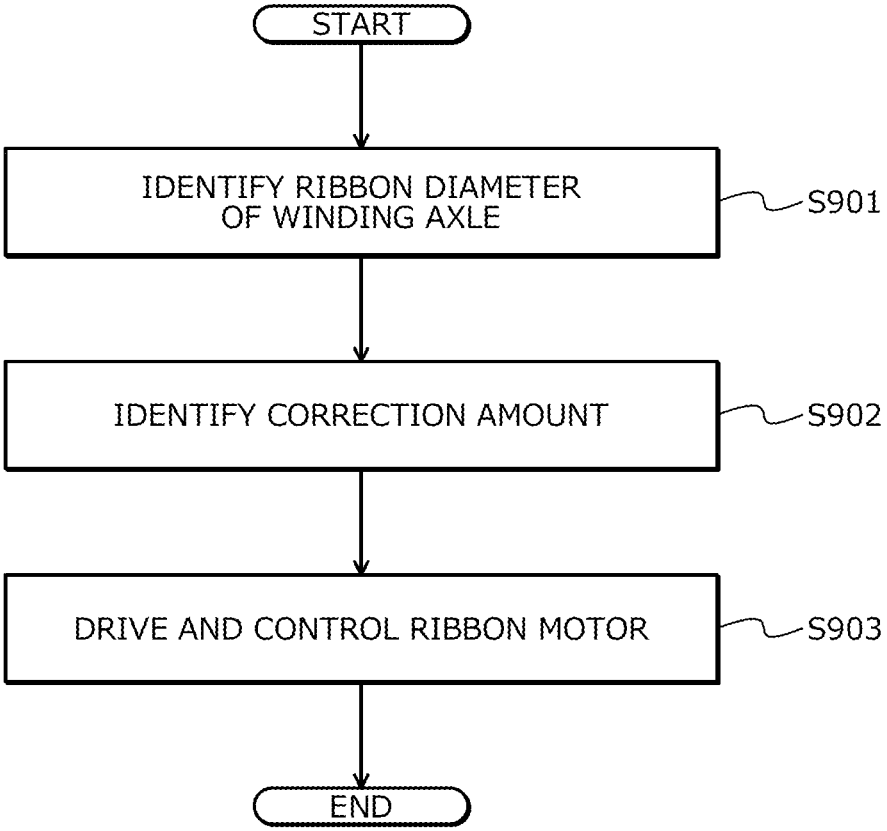
FIG. 9 is a flowchart depicting a process procedure of the printer of the embodiment according to the present invention.

Next, a process procedure of the printer will be described. FIG. 9 is a flowchart depicting a process procedure of the printer 100 of the embodiment according to the present invention. In FIG. 9, a process procedure of the printer when the photographic printing is stopped is depicted. In the flowchart in FIG. 9, first, the ribbon diameter of the winding axle 116*a* is identified (step S901).

Next, the stop position correction table is referred to, and the correction amount corresponding to the ribbon diameter of the winding axle 116*a* identified at step S901 is identified (step S902). Subsequently, based on the correction amount identified at step S902, over-running of the ink ribbon 115 is taken into consideration, and the ribbon motor 302 is driven and controlled so that the ink ribbon 115 stops short of the actual ribbon stop position by the correction amount (step S903), ending a series of processes.

In the embodiment described, while the correction amount is identified according to the ribbon diameter of the winding axle 116*a*, in place of the described method of correcting the stop position according to the ribbon diameter of the winding axle 116*a*, when the photographic printing is stopped, after a ribbon feeding speed is reduced by half, the ribbon motor 302 may be driven and controlled so that the ribbon motor 302 stops.

As a result, as compared to a case where the ribbon motor 302 is stopped with the ribbon feeding speed as is, a period of the over-running is shorter, enabling a standby period until a subsequent operation is performed to be shortened.

Further, in place of the described method of correcting the stop position according to the ribbon diameter of the winding axle 116*a* and the described method of stopping after reducing the ribbon feeding speed by half, over-running may be suppressed by adjusting according to the ribbon feeding speed, the timing at which control (brake control) of stopping conveyance of the ink ribbon 115 is started.

Figure 10:
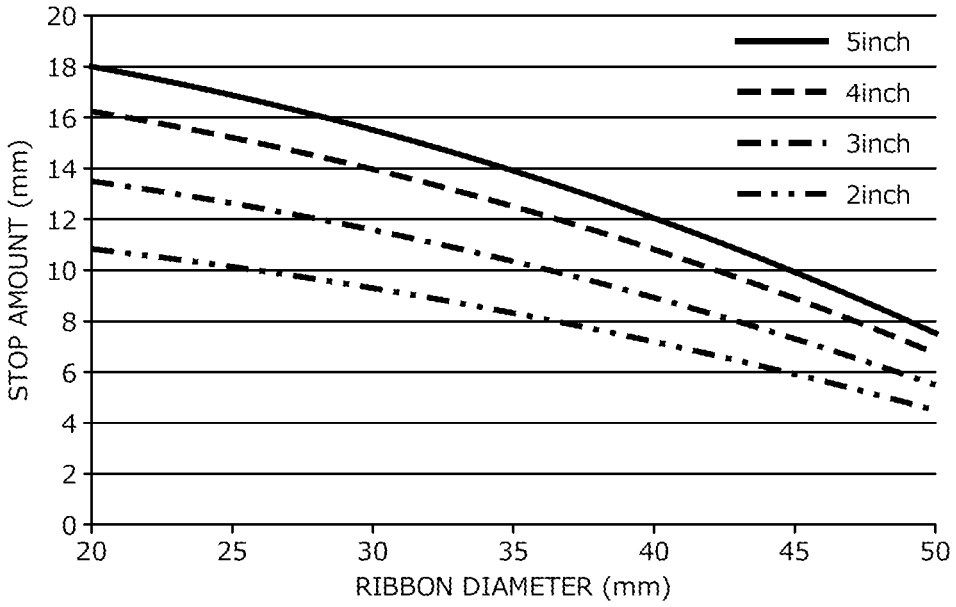
FIG. 10 is a graph depicting a relationship of conveyance speed (ribbon feeding speed) of the ink ribbon and conveyance amount (stop amount) necessary until the ink ribbon is stopped.

FIG. 10 is a graph depicting a relationship of the conveyance speed of the ink ribbon 115 (the ribbon feeding speed) and conveyance amount (stop amount) necessary until the ink ribbon 115 is stopped. As depicted in FIG. 10, the stop amount of the ink ribbon 115 increases as the ribbon feeding speed increases. For example, the stop amount of the ink ribbon 115 is larger for a case in which conveyance is 5 inches per second than for a case in which conveyance is 1 inch per second. Further, the stop amount of the ink ribbon 115, as described, differs according to the magnitude of the ribbon diameter of the winding axle 116*a*.

Therefore, a speed/stop position table storing according to the ribbon feeding speed, distances (conveyance amount of the ink ribbon 115) necessary until the ink ribbon 115 is stopped, is stored in advance in the memory of the microcomputer 701; and based on the speed/stop position table and the ribbon feeding speed in the photographic printing, a distance (braking start distance) until brake control is started is calculated and the brake control is performed at a position of the calculated braking start distance.

(Other Process Procedure of Printer 100)

Figure 11:
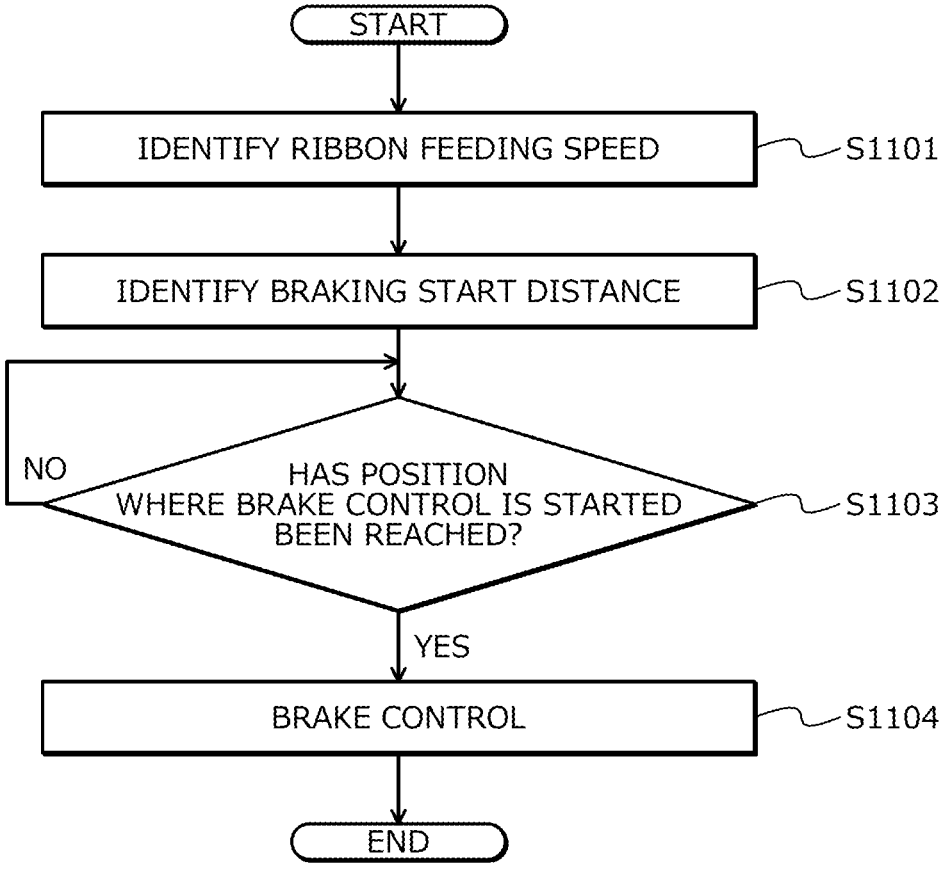
FIG. 11 is a flowchart depicting another process procedure of the printer of the embodiment according to the present invention.

Next, another process procedure of the printer 100 will be described. FIG. 11 is a flowchart depicting another process procedure of the printer 100 of the embodiment according to the present invention. Processes depicted in FIG. 11 are started during photographic printing. In FIG. 11, a process procedure of the printer 100 when the photographic printing is stopped is depicted. In the flowchart in FIG. 11, first, the ribbon feeding speed during the photographic printing is identified (step S1101).

Next, the speed/stop position table is referred to and a braking start distance corresponding to the ribbon feeding speed identified at step S1101 is identified (step S1102). At step S1102, for example, a rotation amount of the winding axle 116*a* necessary until the winding axle 116*a* rotating at the ribbon feeding speed identified at step S110 is stopped is calculated, and to stop the ribbon motor 302 at a position to which the winding axle has been rotated by the calculated rotation amount, a distance (braking start distance) to a position where a brake is applied to the winding axle 116*a* is identified.

Next, based on the braking start distance identified at step S1102, a reaching of the position at which brake control is started is awaited (step S1103: NO). Therefore, at step S1103, when the position at which the brake control is started has been reached (step S1103: YES), the brake control is performed (step S1104), ending a series of processes. At step S1104, the brake control is performed by controlling rotation of the ribbon motor 302.

As described, the printer 100 of the embodiment according to the present invention is characterized by having the ribbon motor 302 as the motor that includes a shaft rotatable around an axis; the winding axle that freely holds for winding, the ink ribbon 115 positioned between the thermal head 110 that realizes a photographic print head that performs a photographic printing operation with respect to the photographic medium 102 conveyed along the sub-scanning direction and the platen roller 111 that opposes the thermal head 110 with the photographic medium 102 between the platen roller 111 and the thermal head 110; the worm gear 501 and the helical gear 502 that realize the rotation transmitting mechanism that transmits to the winding axle, the rotational force of the shaft included in the ribbon motor 302; and the flywheel 303 that is coupled to the shaft of the ribbon motor 302.

According to the printer 100 of the embodiment according to the present invention, inertia of the ribbon motor 302 (inertia) is increased by the flywheel 303 coupled to the shaft included in the ribbon motor 302, whereby the rotational force of the motor transmitted to the winding axle via the worm gear 501 and the helical gear 502 can be suppressed from decreasing when teeth of gears in the worm gear 501 and the helical gear 502 ride over each other. As a result, rotational variation of the ribbon motor 302 decreases, enabling rotational variation of the winding axle to be decreased.

As a result, the winding axle is rotated at a uniform rate, and the ink ribbon 115 held by the winding axle can be sent at an even rate between the thermal head 110 and the platen roller 111. Further, as a result, a uniform image without contrast variation in the sub-scanning direction can be photographically printed, enabling improved photographic printing quality.

Further, according to the printer 100 of the embodiment according to the present invention, regardless of the rotational speed of the winding axle (the ribbon motor 302), the winding axle is rotated at a uniform rate, and the ink ribbon 115 held by the winding axle can be sent at an even rate between the thermal head 110 and the platen roller 111. As a result of this as well, a uniform image without contrast variation in the sub-scanning direction can be photographically printed, enabling improved photographic printing quality.

Further, according to the printer 100 of the embodiment according to the present invention, rotational variation of the winding axle can be reduced without decreasing the size of modules such as that of the helical gear 502 and therefore, photographic printing throughput can be improved without reducing the ribbon feeding speed. Furthermore, according to the printer 100 of the embodiment according to the present invention, rotational variation of the winding axle can be reduced without reducing the size of modules such as that of the helical gear 502 and therefore, durability of the modules associated with conveyance of the ink ribbon 115 can be improved.

Further, the printer 100 of the embodiment according to the present invention is characterized in having the sending out axle that freely holds for sending out, the ink ribbon 115 taken up by the winding axle, and the micro-computer 701 that controls the rotation of the ribbon motor 302, where the micro-computer 701 adjusts according to the outer diameter of the ink ribbon 115 held by the winding axle or the sending out axle, the timing at which the rotation of the ribbon motor 302 is stopped.

According to the printer 100 of the embodiment according to the present invention, the timing at which the rotation of the ribbon motor 302 is stopped is adjusted according to the outer diameter of the ink ribbon 115 and therefore, stopping of the ink ribbon 115 past the position (ribbon stop position) at which the ink ribbon 115 is actually desired to be stopped, so-called over-running (ink ribbon over run) of the ink ribbon, can be suppressed even when due to coupling the flywheel 303 to the shaft of the ribbon motor 302 and due to weight of the winding axle that rotates the ribbon motor 302, inertia of the ribbon motor 302 increases, the inertia when rotation of the winding axle is stopped.

In this manner, over-running is suppressed, whereby stabilization of positioning control of the ink ribbon 115 is facilitated and a uniform image without contrast variation in the sub-scanning direction can be photographically printed. As a result, according to the printer 100 of the embodiment according to the present invention, photographic printing quality can be improved.

Further, the printer 100 of the embodiment according to the present invention may be such that the micro-computer 701 that realizes the control unit may adjust the timing at which the rotation of the ribbon motor 302 stops, so that a stopping period necessary until the rotation of the ribbon motor 302 stops becomes shorter as the outer diameter of the ink ribbon 115 held by the winding axle increases, or as the outer diameter of the ink ribbon 115 held by the sending out axle decreases.

According to the printer 100 of the embodiment according to the present invention, over-running of the ink ribbon can be suppressed even when due to coupling the flywheel 303 to the shaft of the ribbon motor 302 and increasing the weight of the winding axle that rotates the ribbon motor 302, inertia of the ribbon motor 302 increases, the inertia when the rotation of the winding axle 116*a* is stopped. As a result, stabilization of positioning control of the ink ribbon 115 is facilitated and a uniform image without contrast variation in the sub-scanning direction can be photographically printed, enabling photographic printing quality to be improved.

Further, the printer 100 of the embodiment according to the present invention includes the micro-computer 701 that controls rotation of the ribbon motor 302, where the micro-computer 701 may stop the rotation of the ribbon motor 302, after reducing the rotational speed of the ribbon motor 302 stepwise.

According to the printer 100 such as this, by stopping the rotation of the ribbon motor 302 after the rotational speed of the ribbon motor 302 is reduced stepwise, even when due to coupling the flywheel 303 to the shaft of the ribbon motor 302, inertia of the ribbon motor 302 increases, the inertia when the rotation of the winding axle is stopped, over-running of the ink ribbon is suppressed and stabilization of positioning control of the ink ribbon 115 can be facilitated. As a result, a uniform image without contrast variation in the sub-scanning direction can be photographically printed and photographic printing quality can be improved.

Further, the printer 100 of the embodiment according to the present invention includes the micro-computer 701 that controls the rotation of the ribbon motor 302, where the micro-computer 701, based on the rotational speed of the ribbon motor 302 during rotation, may identify the rotation amount of the winding axle for the winding axle to stop and based on the identified rotation amount, may perform control of stopping the rotation of the ribbon motor 302.

According to the printer 100 such as this, by performing at a position that corresponds to the rotational speed and according to the ribbon feeding speed, i.e., the rotational speed of the ribbon motor 302, the brake control, i.e., control of stopping the rotation of the ribbon motor 302, even when the ribbon feeding speed is variously set according to operation mode (high-speed photographic printing mode, high-quality photographic printing mode, etc.) in the printer 100, over-running of the ink ribbon is suppressed, enabling stabilization of positioning control of the ink ribbon 115 to be facilitated. As a result, a uniform image without contrast variation in the sub-scanning direction can be photographically printed and photographic printing quality can be improved.

INDUSTRIAL APPLICABILITY

As described, the printer according to the present invention us useful for printers that perform photographic printing using an ink ribbon and is particularly suitable for printers of which high photographic printing quality is demanded.

EXPLANATIONS OF LETTERS OR NUMERALS

100 printer
102 photographic medium
110 thermal head
111 platen roller
115 ink ribbon
302 ribbon motor
303 flywheel
401 ribbon motor encoder
501 worm gear
502 helical gear
701 the micro-computer

What is claimed is:

1. A printer comprising:

a motor that includes a shaft rotatable around an axis;

a winding axle that freely holds for winding, an ink ribbon positioned between a photographic print head that performs a photographic printing operation with respect to a photographic medium conveyed along a sub-scanning direction and a platen that opposes the photographic print head with the photographic medium between the photographic print head and the platen;

a rotation transmitting mechanism that transmits to the winding axle, a rotational force of the shaft included in the motor;

a flywheel that is coupled to the shaft;

a sending out axle that freely holds for sending out, the ink ribbon taken up by the winding axle; and a control unit that controls rotation of the motor, wherein the control unit adjusts according to an outer diameter of the ink ribbon held by the winding axle or the sending out axle, a timing at which the rotation of the motor is stopped.

2. The printer according to claim 1, wherein:

the control unit adjusts the timing at which the rotation of the motor is stopped so that a stopping period necessary until the rotation of the motor stops becomes shorter, as the outer diameter of the ink ribbon held by the winding axle increases or as the outer diameter of the ink ribbon held by the sending out axle decreases.

3. The printer according to claim 1, further comprising:

a control unit that controls rotation of the motor, wherein the control unit stops the rotation of the motor after reducing the rotation of the motor stepwise.

4. The printer according to claim 1, further comprising:

a control unit that controls rotation of the motor, wherein the control unit, based on a rotational speed of the motor during rotation, identifies a rotation amount of the winding axle for the winding axle to stop and based on the identified rotation amount, performs control of stopping the rotation of the motor.

* * * * *